United States Patent [19]

Kieft et al.

[11] 4,222,141

[45] Sep. 16, 1980

[54] STREET SWEEPER AND MAIN BROOM SUSPENSION

[75] Inventors: Gerald N. Kieft, St. Charles; Donald L. Hildebrand, Union, both of Ill.

[73] Assignee: Elgin Sweeper Company, Elgin, Ill.

[21] Appl. No.: 36,008

[22] Filed: May 4, 1979

[51] Int. Cl.[3] ..... E01H 1/04

[52] U.S. Cl. ..... 15/84

[58] Field of Search ..... 15/82–87, 15/340

[56] References Cited

U.S. PATENT DOCUMENTS

| | | | |
|---|---|---|---|
| 793,700 | 7/1905 | Whittemore | 15/83 X |
| 897,705 | 9/1908 | Beeman | 15/84 |
| 3,071,793 | 1/1963 | Lull | 15/82 |
| 3,363,274 | 1/1968 | Tamny | 15/84 |

FOREIGN PATENT DOCUMENTS

| | | | |
|---|---|---|---|
| 1251690 | 10/1971 | United Kingdom | 15/84 |

*Primary Examiner*—Edward L. Roberts

*Attorney, Agent, or Firm*—Hill, Van Santen, Steadman, Chiara & Simpson

[57] ABSTRACT

A self-propelled street sweeper including a main frame, sweepings pick-up means underlying the main frame and a dirt box positioned on the frame for receiving the sweepings. A main broom is mounted at a rear end of the main frame adapted to sweep sweepings to the sweepings pick-up means or conveyor so the sweepings can be deposited into the dirt box and having sweeping and road travel positions. Means is provided for driving the main broom when in its sweepings position. Means is further provided for suspending the main broom from the rear end of the main frame including suspension arms located on opposite sides of the main broom. Bearing means are provided between the suspension arms and the opposite sides of the main broom. Floating suspension means is operatively connected between the main broom and the main frame providing a floating suspension for enabling the main broom to freely float on a ground supporting surface as the main broom is dragged behind the main frame in road engagement. The sweeper including the main frame and the main broom has a longer overall length when the main broom is in its sweepings position as compared to when the main broom is in a road travel position. Broom lift mechanism is connected with said suspension arms and is operatively inactive when the main broom is in floating suspension in its sweepings position and which is operable to move the main broom forwardly through an arc out of road engagement over the main frame to its road travel position, thus then shortening the overall length of the sweeper for road travel.

13 Claims, 7 Drawing Figures

Fig. 3
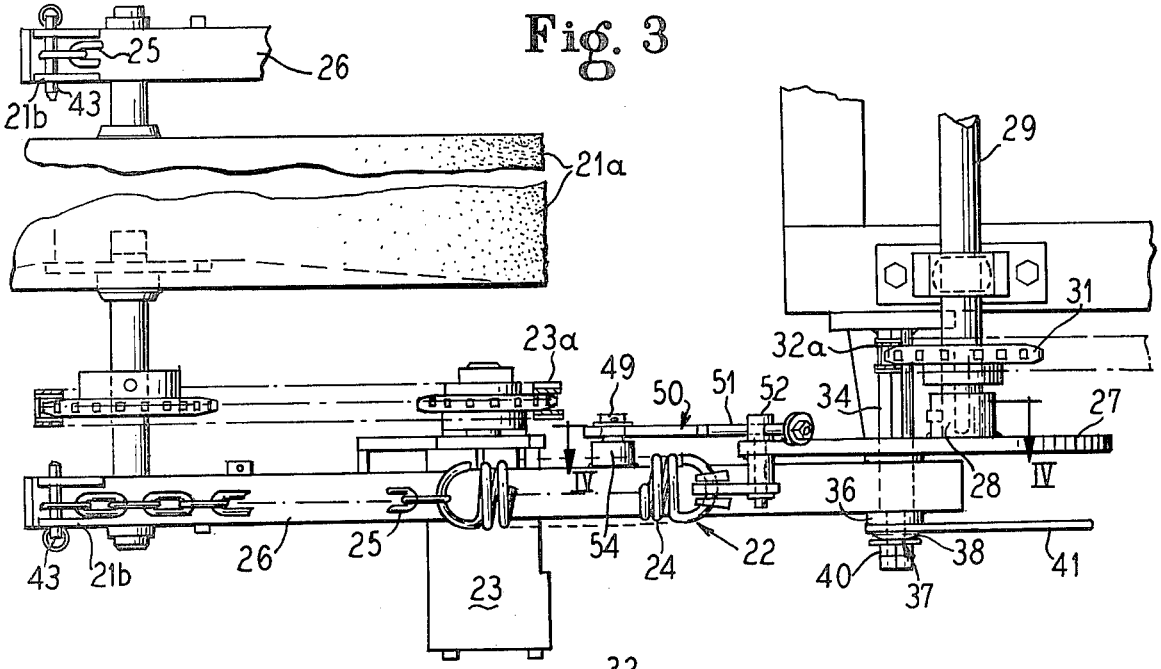
Fig. 5
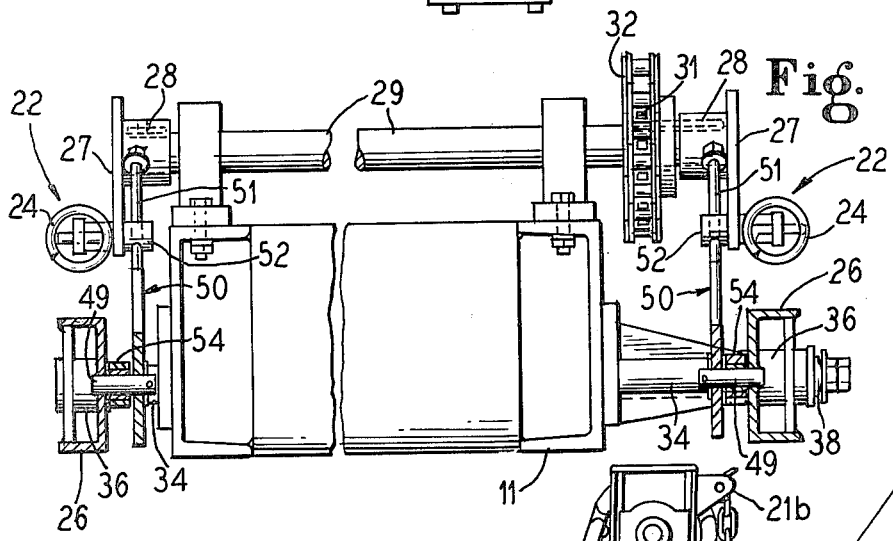
Fig. 7
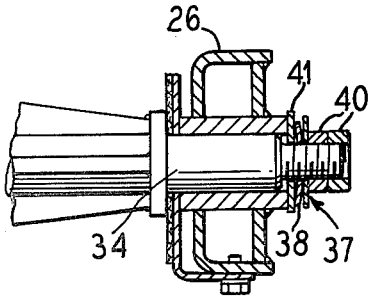
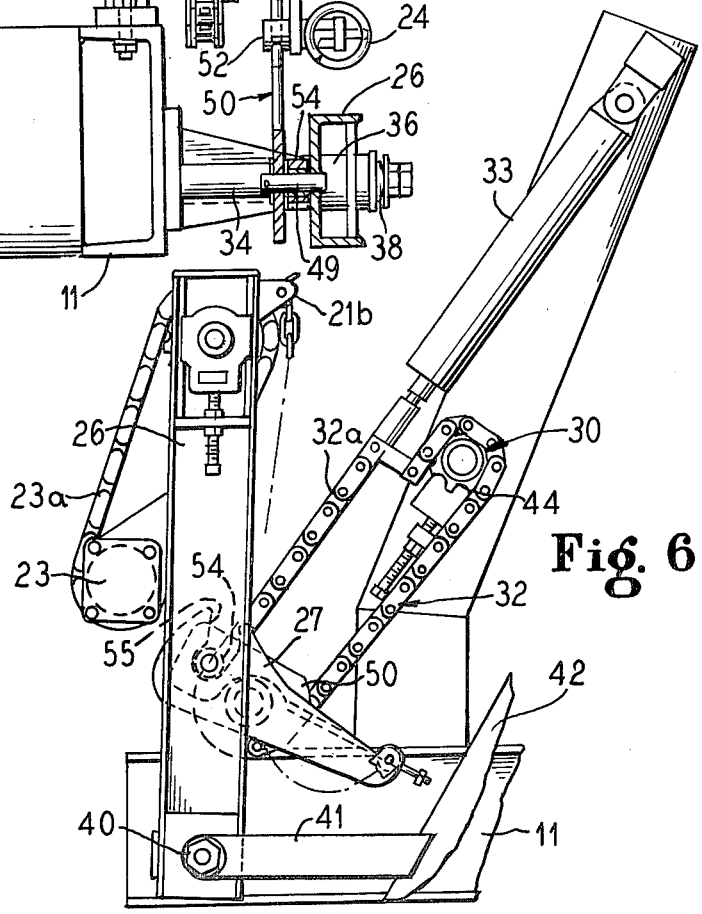
Fig. 6

STREET SWEEPER AND MAIN BROOM SUSPENSION

BACKGROUND OF THE INVENTION

1. Field of the Invention

The present invention relates to a street-sweeping machine.

2. Prior Art Involving Rear Mounted Pick-up Brooms on Truck-Type Sweeper

In previous designs of truck-type broom sweepers, with the dirt hopper near the middle of the vehicle, the pick-up broom at the extreme rear, and a conveying mechanism in between the broom and hopper, it has been the practice to suspend the pick-up broom from the rear of the vehicle with just enough vertical movement of the broom so that it would reach the ground for sweeping and lift off of the ground for vehicle transport, and just high enough to clear the ground when the vehicle traversed over rough roads, at dump sites, or when starting or exiting from an incline such as a driveway or ramp.

This small amount of vertical broom movement required the simplest lift mechanism but resulted in several disadvantages which are:

1. Extended the overall length of the vehicle when transporting that made vehicle maneuverability in traffic and when parking more difficult.
2. Extended the overhung length behind the rear axle of the vehicle which made the broom vulnerable to hitting light poles and signs during a short radius turn. This also resulted in additional cantilever loading on the rear axle which was already heavily cantilever loaded due to other mechanism such as auxiliary engine and water tank located behind the rear axle.
3. Relied on hydraulic pilot operated check valves to hold the broom in the "up" position while the sweeper was being stored overnight, over weekends, or extended periods when the weather was not conducive to sweeping. Hydraulic pilot operated check valves normally allow some oil to leak through thus allowing the broom to drop to the ground. If the broom is permitted to stay on the ground for several days, the bent broom fibers often take a permanent set which produces a flat spot on the broom, throwing it out of balance thereby causing early and expensive broom replacement.
4. Some prior broom suspensions relied only on the weight of the broom and broom arms to hold the broom center at the correct distance from the road for sweeping. The broom was limited in distance from the center of the broom to the surface of the road by a chain or cable to give a correct sweeping pattern, but only relied on the broom and suspension weight to keep the broom on the ground. When the rear wheels of the sweeper would go over a ridge or rough spot or hole in or on the road and where the broom was cantilevered about the sweeper rear axle, the main broom would have a tendency to bounce and lift off the road resulting in strips of unswept dirt being left on the road. In the sweeper art, this unsatisfactory operation of the main broom is commonly referred to as "broom skipping" or "broom bouncing".

ADVANTAGES OF THIS INVENTION

The broom suspension herein disclosed has five main advantages:

1. The broom suspension shortens the overall length of the sweeper during transport.
2. The broom suspension reduces the overhung weight behind the rear axle thus making the sweeper more stable and the ride more comfortable when the sweeper is in transport to and from sweeping sites and/or dump sites.
3. The broom suspension has a reverse ramp on a swivel cam that mechanically locks the main broom in the "up" position with the center of gravity of the broom only slightly to the rear of the suspension pivot point. Therefore, no hydraulic locking valves are required to hold the broom up.
4. The broom suspension performs the 130° approximate translation of the main broom with a simple linkage and lever system activated by a single hydraulic cylinder.
5. The broom suspension incorporates an adjustable broom snubber to provide controlled friction in the broom suspension arms so that the tendency of the broom to bounce up is reduced while still allowing the broom to work at the normal lowest position limited by a stop chain. The stop chain is fastened to an extension spring designed to allow the broom to automatically follow the contour of a depression or dip in the surface being swept. The width of broom contact commonly known as "broom pattern", in the depression is reduced from the width on a flat even street, yet this small amount of allowable movement prevents dirt from being deposited in transverse depressions in the street which depressions are encountered in normal sweeping. The concept of using an extension spring or compression spring in the broom suspension to allow the broom to sweep shallow depressions has been used in the past.

SUMMARY OF THE INVENTION

According to important features of this invention, we have provided a self-propelled street sweeper including a main frame. Sweepings pick-up means is positioned underneath the main frame and a dirt box is positioned on the frame for receiving the sweepings. Our improvement includes the idea of providing a main broom mounted at a rear end of the main frame adapted to sweep sweepings to the sweepings pick-up means so the sweepings can be deposited into the dirt box when the main broom is in its sweeping position. Means are provided for driving the main broom when in its sweeping position. Means is further provided for suspending the main broom from the rear end of the main frame including suspension arms located on opposite sides of the main broom. Bearing means are provided between the suspension arms and the opposite sides of said main broom. Still further, floating suspension means is operatively connected between the main broom and the main frame providing a floating suspension for enabling the main broom to freely float on a ground supporting surface as the main broom is dragged behind the main frame in road engagement. The sweeper including the main frame and the main broom has a lower overall length when the main broom is in its sweeping position as compared to when the main broom is in its road travel position. A broom lift mechanism is connected with the suspension arms which is operatively inactive when the main broom is in floating suspension in its sweeping position and which is operable to move the main broom forwardly through an arc out of road engagement over the main frame to its road travel position, thus then shortening the overall length of the sweeper for road travel.

Other features of this invention concern providing the broom lift mechanism with a hydraulically operated ram, and means cooperates with said broom lift mechanism for providing support means for the main broom when in a road travel position for supporting the main broom independently of the hydraulically operated ram.

In view of the unique construction of the broom lift mechanism and the coordinated components, the main broom can move from its sweeping position through an arc of approximately 130 degrees to its road travel position and with said broom lift mechanism being actuatable through said 130 degree arc by means of only a single hydraulic cylinder.

As a more specific object of this invention we have provided an adjustable broom snubber for providing controlled friction in said suspension arms for minimizing any tendency of the broom to bounce when in its sweeping position, and a stop chain and an extension spring cooperable together to allow the broom to automatically follow the contour of a depression or dip in a road surface being swept.

Still other features of the invention require that the broom lift mechanism includes a hydraulically operated ram for moving the broom through its arc. Still further, the suspension arms and said broom lift mechanism are so constructed and oriented relative to one another to permit said broom to be moved through its arc and positioned on said main frame in its road travel position in an at-rest position on the main frame for supporting the main broom independently of the hydraulic ram.

Other objects and features of the invention will more fully become apparent in view of the following detailed description of the drawings wherein a single embodiment is disclosed.

ON THE DRAWING

FIG. 3 is an enlarged fragmentary cross-sectional view in full and broken line taken on the line III—III looking in the direction indicated by the arrows as seen in FIG. 2;

FIG. 5 is a fragmentary view with parts in section as taken on the line V—V looking in the direction indicated by the arrows as seen in FIG. 2;

FIG. 6 is a side view of the broom suspension with the broom shown in its road travel position; and FIG. 7 is an enlarged fragmentary view illustrating details of the snubber.

AS SHOWN ON THE DRAWINGS

Figure 1:
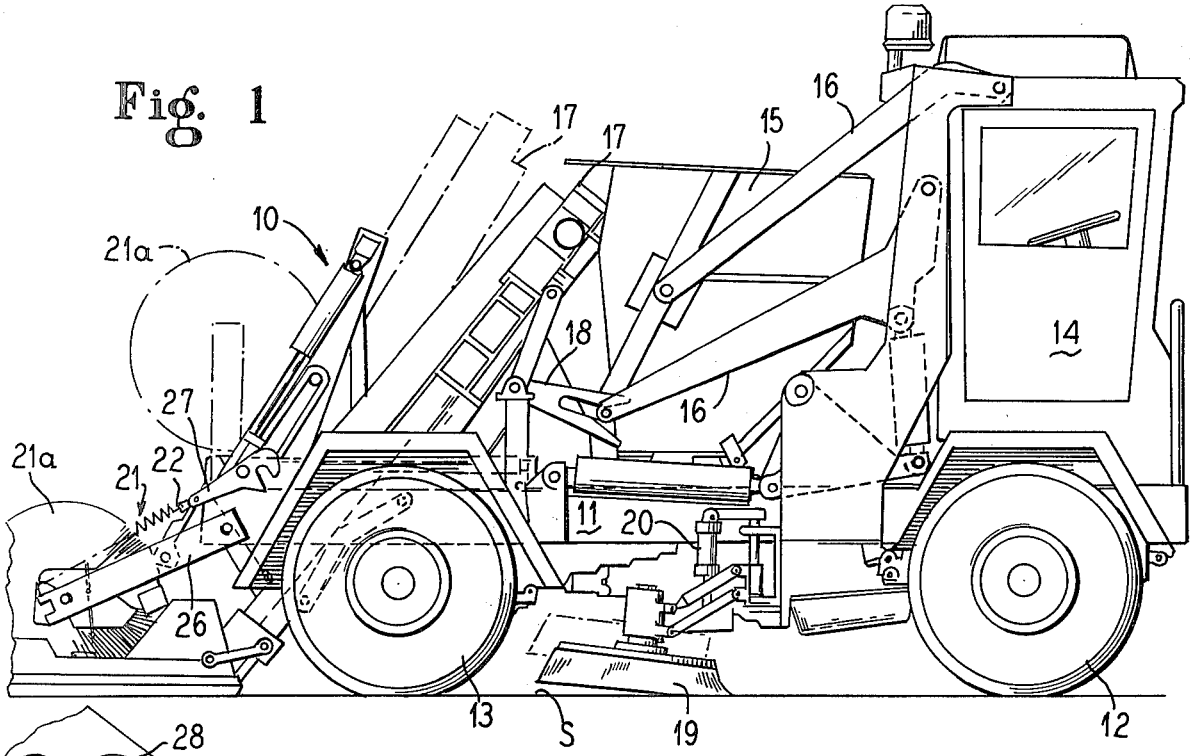
FIG. 1 is a side view of our street sweeper which embodies the features of our invention.

The reference numeral 10 indicates generally a self-propelled, four-wheeled street sweeper of the type that is particularly adapted to travel at high speeds on the open highways when loaded or unloaded and which is also capable of operating at slower speeds when sweeping the streets. The street sweeper 10 includes a main frame 11 that is supported by a front axle mounted on a pair of front wheels 12 and a rear axle mounted on a pair of rear wheels 13. An operator's cab 14 is disposed at the front end of the sweeper 10 above a single engine. Immediately behind the cab is a dirt hopper 15 that is ordinarily supported on the main frame 11 when positioned to receiving sweepings and which is elevatable over the cab for unloading the sweepings from the hopper. A powered hopper elevating mechanism 16 is provided for moving the dirt hopper 15 in an arc from its sweeping receiving position behind the cab to its dumping position over and in front of the cab 14. Before the mechanism 16 can be operated, outriggers (not shown) can be operated through the controls to provide support for the cab end or forward end of the sweeper for the time when the hopper 15 is elevated over the cab as will be more fully described in connection with the description of the hydraulic circuit that follows and as also described in assignee's U.S. application for patent entitled "Street Sweeper Having an Elevating Hopper with Supporting Outriggers", U.S. Ser. No. 966,494, alternatively counter balancing means can be installed at the rear end of the sweeper for supporting the sweeper against any tendency to tip forward when the hopper is in its elevated forward position.

Shiftably mounted on the frame immediately behind the dirt hopper 15 is a tiltable sweepings conveyor 17. The conveyor 17 is adapted to transport sweepings from ground level to an elevated position into the hopper 15 when the hopper is positioned for receiving the sweepings. Pivotal linkage means 18 is provided for tilting a conveyor 17 to move its upper end so the hopper may be moved through its arc while supported by the powered hopper elevating mechanism 16 free of interference with the conveyor 17.

Supported on a frame 11 at its opposite sides are a pair of side brooms 19. If desired, only one side broom can be used. The pivotal linkage 18 for tilting the conveyor 17 is operated by the powered hopper elevating mechanism 16. Means 20 is provided for moving the side brooms from a transport position to a sweeping position. When in a sweeping position, the brooms 19 are rotatable to throw sweepings from the gutter into the path of main broom assembly 21. Main broom assembly 21 is rotatably driven by a hydraulic motor 23 through a chain drive arrangement **23*a* to throw the sweepings onto conveyor 17 and the conveyor cleats are adapted to transport the sweepings and unload the same into the dirt hopper 15** in a conventional manner.

The details concerning the operation of the pivotal linkage 18 and the mechanism for raising the hopper are described in greater detail in the assignee's U.S. application for patent entitled "Four-Wheeled Sweeper", U.S. Ser. No. 940,598 now U.S. Pat. No. 4,178,647.

Positioned at the rear end of the sweeper 10 is the main broom assembly 21.

The main broom assembly 21 is suspended at an appropriate sweeping height above the road surface by means of a floating suspension device 22 which provides a means of adjustably regulating the loading or pressure of broom **21*a* against road surface S. The floating suspenion device 22 permits the broom to contact the roadway surface S and provides a "floating action" in which the broom 21*a*** generally retains its sweeping position relative to the road surface despite up-and-down bouncing motion of the sweeper rear axle as the wheels pass over rough spots in the road. Thus, the broom 21*a* is able to be held in a correct sweeping pattern without lifting off the roadway which is commonly referred to as "broom skipping". With the disclosed floating suspension device 22, the main broom will sweep into rough spots or dips in the road and after the rear wheels have passed over them. The suspension device 22 includes a tension spring 24 and stop chain 25 connected between each broom suspension arm or frame 26 at the broom mounting ends 21*b*, and rotatable lift arms 27. The lift arms 27 are fixedly mounted at 28 to opposite sides of a cross shaft 29 which is supported on the sweeper main frame 11 and comprise a rotary lift assembly 30 which is rotatable to move the broom 21*a* between a lowered sweeping position and a raised traveling position.

A sprocket 31, also secured to the cross shaft 29 provides for a drive input to rotate the cross shaft 29. A roller chain assembly 32 including chain 32*a* powers the sprocket 31 and is connected to a hydraulic lift cylinder 33 which drives the roller chain 32*a* to activate the lift assembly 30. Thus, with the lift arms 27 in their lowered positions, the broom mounting ends 21*b* of the suspension arms 26 are each supported in cantilevered fashion from each side of the sweeper main frame 11 on a pivot support stub shaft 34.

The broom suspension arms 26 are supported on a related stub shaft 34 by means of a bearing sleeve 36 having a snubber arrangement 37 associated therewith. The snubber 37 (FIG. 7) includes a cone or cone type "bellville" spring 38 which may be adjustably loaded to provide a pivotal restraining frictional bias against the suspension arms to minimize excessive pivotal movement of the broom assembly 21 due to bounce. Adjusting nuts 40 threaded on the stub shaft 34 bear against a complementary fixed damping plate 41 to load the cone springs 38 and provide frictional bias between the plate and the bearing sleeve 36. The damping plate 41 is fixed to the sweeper at a convenient point such as to the rear fenders of the sweeper. The cone spring 38 is not loaded to the extent of interferring with the desired floating action but only to the point which will minimize the bounce associated with traversing rough roads, etc. When the rear wheels 13 encounter bumps in the roadway, the yielding support of the broom assembly 21 allows the wheels to go over the bump while the broom 21*a* in its floating action continues approximately along at a constant level relative to the road surface without the customary skipping action of brooms associated with the prior art using a fixed broom supporting arrangement.

Pin couplings 43 of the stop chain 25 support the broom mounting ends of the suspension arms 26 for adjustment of the broom 21*a* sweeping contact with the road surface and also for bristle wear.

Figure 4:
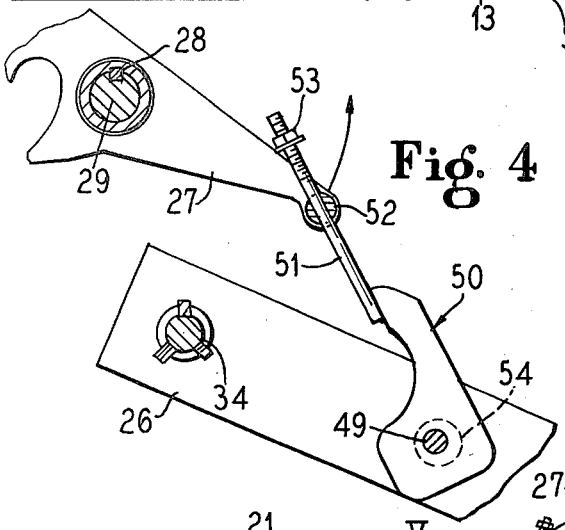
FIG. 4 is an enlarged fragmentary view with parts in section as viewed on the line IV—IV, looking in the direction indicated by the arrows as seen in FIG. 3.
Figure 2:
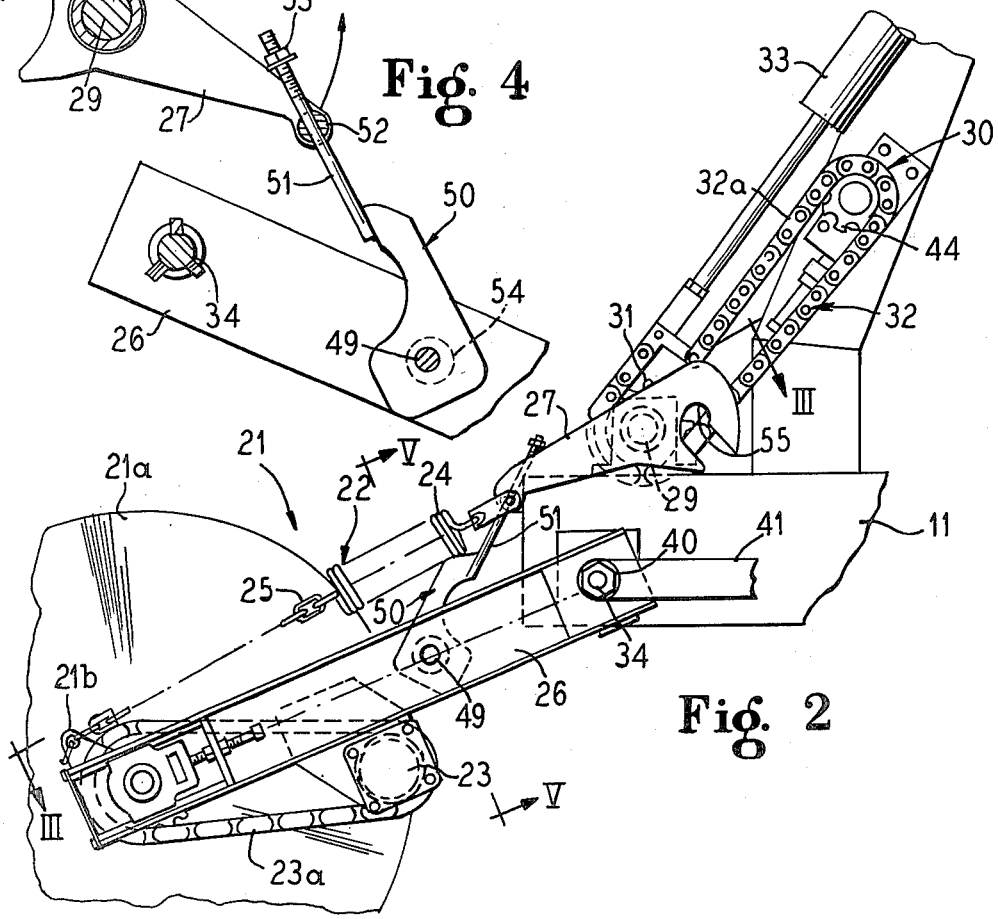
FIG. 2 is an enlarged fragmentary side view with parts shown in full and dotted lines, showing the main broom and its manner of suspension from the rear end of the sweeper.

When elevating the broom 21*a*, the hydraulic lifting cylinder 33 is retracted to orbitally move the roller chain 31*a* about sprockets 31 and 44, the sprocket 31 being the sprocket affixed to the cross shaft 29 of the rotary lift assembly 30 and imparting a rotary motion to the cross shaft 29 and lift arms 27. As the lift arms rotate in a clockwise direction, as best seen in FIG. 2, the floating suspension device 22 (spring and stop chain) attached to the broom mounting end of the suspension arms initially elevated the broom assembly 21 through a first elevating stage. After initial lift stage lifting links 50 come into favorable angular lifting operation allowing chain 25 and spring 24 to become relaxed so the tension can be adjusted at pin 43. Thereafter, a pair of pick-up lifting links 50 pivotably connected to the suspension arms on a pin 49 come into favorable angular lifting orientation. The lifting links each include a lift rod 51 which when in normal sweeping position is slidably carried by a pivot slide connector 52 (FIG. 4) with a nut 53 adjustable setting the point at which the lifting links take over from the chain 25 and spring 24 providing the first lifting action. The geometry of the pivots and arm lengths provide a smooth transfer of lifting forces between the lifting devices. The lifting links when in lifting communication with the pivotal slide connectors 52 (when the nut 53 is supported on the connector 52) carry the broom assembly 21 upward to a near vertical position when the third lifting phase takes over. Herein, a roller 54, best seen in FIG. 5 is introduced into a camming slot 55 formed in each of the lift arms 27 opposite the lifting connection with the broom assembly. The slots 55 and rollers 54 providing the final upward movement of the broom assembly with the final few degrees of rotation of the lift arms 27 being effective to lock the broom assembly 21 in a generally vertical position as seen in FIG. 6. The cam slots are also effective to lower the broom assembly by camming the broom suspension arms 26 downward and rearward to the point where the lifting links 50 assume the support of the broom assembly 21. Each of the lifting phases provides an important function relative to pivoting the broom assembly, namely: first the chain/spring floating suspension device 22 provides a means to initiate the broom pick-up from the road surface. Once the broom assembly is elevated to a desired point the lift rods 51 of the lifting links 50 and sliding connectors 52 take over and provides swing movement of suspension arms 26 to the point where the cam slot 55 lifting phase takes over. The first phase provides the spring suspension for sweeping with no rigid mechanical restriction on broom travel except if the broom should reach an extreme down position at which the lift rod 51 would bottom out against connector 52. The second phase is achieved due to the geometrical relationship between broom arm pivot, broom mounting end 21*b*, suspension arm pin 49, and lift arm 27. This phase provides a smooth transition between spring suspension and positive mechanical lifting, slack in chain 25 so adjustment to spring tension can be made at pin 43, and a rigid mechanical lifting mechanism required to time the transition to phase three smoothly. This third phase thereupon moves the arms to a secure stowed position in which the broom assembly 21 is mechanically locked in its elevated position and hydraulic pressure is no longer required to hold or support the broom assembly.

We claim:

1. In a self-propelled street sweeper including a main frame, sweepings pick-up means underlying the main frame and a dirt box positioned on the frame for receiving the sweepings, the improvememt comprising:

a main broom structure including a main broom mounted at a rear end of said main frame adapted to sweep sweepings to the sweepings pick-up means so the sweepings can be deposited into the dirt box and having sweeping and road travel positions;

means for driving said main broom when in its sweeping position;

means for suspending the main broom from the rear end of said main frame including suspension arms located on opposite sides of said main broom;

bearing means between said suspension arms and said opposite side of said main broom; and floating suspension means operatively connected between said main broom and said main frame providing a floating suspension for enabling said main broom to freely float on a ground supporting surface as the main broom is dragged behind said main frame in road engagement, said suspension means including adjustable broom snubber means for providing controlled friction to at least one of said suspension frames for minimizing any tendency of the broom to bounce when in its sweeping position, and a stop chain and an extension spring cooperable together and with said main broom to allow the main broom to follow the contour of a depression or dip in a road surface being swept.

2. The sweeper of claim 1 further characterized by including broom lift mechanism having a hydraulically operated ram for moving the broom through an arc between sweeping and road travel positions, and the suspension arms and said broom lift mechanism being so constructed and oriented relative to one another to permit said broom to be moved through its arc and positioned on said main frame in its road travel position in an at-rest position on the main frame for supporting the main broom and relieving the hydraulic ram from supporting the main broom while in a road travel position.

3. In a self-propelled street sweeper including a main frame, sweepings pick-up means underlying the main frame and a dirt box positioned on the frame for receiving the sweepings, the improvement comprising:

a main broom mounted at a rear end of said main frame adapted to sweep sweepings to the sweepings pick-up means so the sweepings can be deposited into the dirt box and having sweeping and road travel positions;

means for driving said main broom when in its sweeping position;

means for suspending the main broom from the rear end of said main frame including suspension arms located on opposite sides of said main broom;

bearing means between said suspension arms and said opposite sides of said main broom;

floating suspension means operatively connected between said main broom and said main frame providing a floating suspension for enabling said main broom to freely float on a ground supporting surface as the main broom is dragged behind said main frame in road engagement, the sweeper including the main frame and the main broom having a longer overall length when said main broom is in its sweeping position as compared to its road travel position;

and broom lift mechanism connected with said suspension arms which is operatively inactive when said main broom is in floating suspension in its sweeping position and which is operable to move said main broom forwardly through an arc out of road engagement over the main frame to its road travel position, thus then shortening the overall length of the sweeper for road travel, said suspension means including adjustable broom snubber means for providing controlled friction in said suspension arms for minimizing any tendency of the broom to bounce when in its sweeping position, and a stop chain and an extension spring cooperable together and with said main broom to allow the main broom to follow the contour of a depression or dip in a road surface being swept.

4. In a self-propelled street sweeper including a main frame, sweepings pick-up means underlying the main frame and a dirt box positioned on the frame for receiving the sweepings, the improvement comprising:

a main broom mounted at a rear end of said main frame adapted to sweep sweepings to the sweepings pick-up means so the sweepings can be deposited into the dirt box and having sweeping and road travel positions;

means for driving said main broom when in its sweeping position;

means for suspending the main broom from the rear end of said main frame including suspension arms located on opposite sides of said main broom;

bearing means between said suspension arms and said opposite sides of said main broom;

floating suspension means operatively connected between said main broom and said main frame providing a floating suspension for enabling said main broom to freely float on a ground supporting surface as the main broom is dragged behind said main frame in road engagement, the sweeper including the main frame and the main broom having a longer overall length when said main broom is in its sweeping position as compared to its road travel position;

and broom lift mechanism connected with said suspension arms which is operatively inactive when said main broom is in floating suspension in its sweeping position and which is operable to move said main broom forwardly through an arc out of road engagement over the main frame to its road travel position, thus then shortening the overall length of the sweeper for road travel, said broom lift mechanism including a hydraulically operated ram for moving the broom through its arc, and the suspension arms and said broom lift mechanism being so constructed and oriented relative to one another to permit said broom to be moved through its arc and positioned on said main frame in its road travel position in an at-rest position on the main frame for supporting the main broom and relieving the hydraulic ram from supporting the main broom while in said road travel position.

5. The sweeper of claim 4, further characterized by providing locking means cooperable between said suspension arms and said main broom positively locking said main broom in an upright position at the rear end of the main frame thus enabling hydraulic pressure in the hydraulically operated ram for moving the broom through its arm to be released when the main broom is in its locked road travel position.

6. In a self-propelled street sweeper including a main frame, sweepings pick-up means underlying the main frame and a dirt box positioned on the frame for receiving the sweepings, the improvement comprising:

a main broom mounted at a rear end of said main frame adapted to sweep sweepings to the sweepings pick-up means so the sweepings can be deposited into the dirt box and having sweeping and road travel positions;

means for driving said main broom when in its sweeping position;

means for suspending the main broom from the rear end of said main frame including suspension arms located on opposite sides of said main broom;

bearing means between said suspension arms and said opposite sides of said main broom;

floating suspension means operatively connected between said main broom and said main frame providing a floating suspension for enabling said main broom to freely float on a ground supporting surface as the main broom is dragged behind said main frame in road engagement, the sweeper including the main frame and the main broom having a longer overall length when said main broom is in its sweeping position as compared to its road travel position;

and broom lift mechanism connected with said suspension arms which is operatively inactive when said main broom is in floating suspension in its sweeping position and which is operable to move said main broom forwardly through an arc out of road engagement over the main frame to its road travel position, thus then shortening the overall length of the sweeper for road travel, the main broom being movable from its sweeping position through an arc of approximately 130 degrees to its road travel position and with said broom lift mechanism being actuatable through said 130 degree arc, and locking means for securing said main broom to said main frame in said road travel position.

7. In a self-propelled street sweeper including a main frame, sweepings pick-up means supported by the main frame and a dirt box positioned on the frame for receiving the sweepings, the improvement comprising:

a main broom structure including a main broom mounted at a rear end of said main frame adapted to sweep sweepings to the sweepings pick-up means so the sweepings can be deposited into the dirt box and having sweeping and road travel positions;

means for suspending the main broom from the rear end of said main frame including suspension arms located on opposite sides of said main broom;

bearing means between said suspension arms and said opposite sides of said main broom;

suspension means operatively connected between said suspension arms for said main broom and said main frame providing a suspension for enabling said main broom to engage a ground supporting surface as the main broom is dragged behind said main frame in road engagement;

and broom lift mechanism operatively connected with said main broom structure which is operatively inactive when said main broom is in road engagement in its sweeping position and which is operable to move said main broom forwardly through an arc out of road engagement over the main frame to its road travel position, thus then shortening the overall length of the sweeper for road travel, the sweeper including the main frame and the main broom having a longer overall length when said main broom is in its sweeping position as compared to its road travel position, said suspension means including adjustable broom snubber means for providing controlled friction in said suspension frames for minimizing any tendency of the broom to bounce when in its sweeping position, and a stop chain and an extension spring cooperable together and with said main broom to allow the main broom to follow the contour of a depression or dip in a road surface being swept.

8. The sweeper of claim 7 further characterized by the broom lift mechanism including ram means being hydraulically operable for moving the broom, and means cooperable with said broom lift mechanism for providing an independent support means for the main broom when in a road travel position for supporting the main broom independently of the hydraulically operated ram when said main broom is disposed in its road travel position.

9. The sweeper of claim 7 further characterized by said broom lift mechanism including a hydraulically operated ram for moving the broom through its arc, and the suspension arms and said broom lift mechanism being so constructed and oriented relative to one another to permit said main broom to be moved through its arc and positioned on said main frame in its road travel position in an at-rest position on the main frame for supporting the main broom and relieving the hydraulic ram from supporting the main broom while in a road travel position.

10. In a self-propelled street sweeper including a main frame, sweepings pick-up means underlying the main frame and a dirt box positioned on the frame for receiving the sweepings, the improvement comprising:

a main broom structure including a main broom mounted at a rear end of said main frame adapted to sweep sweepings to the sweepings pick-up means so the sweepings can be deposited into the dirt box and having sweeping and road travel positions;

means for driving said main broom when in its sweeping position;

means for suspending the main broom from the rear end of said main frame including suspension arms located on opposite sides of said main broom;

bearing means between said suspension arms and said opposite side of said main broom; and floating suspension means operatively connected between said main broom and said main frame providing a floating suspension for enabling said main broom to freely float on a ground supporting surface as the main broom is dragged behind said main frame in road engagement, said suspension means including adjustable broom snubber means for providing controlled friction to at least one of said suspension frames for mininimizing any tendency of the broom to bounce when in its sweeping position.

11. In a self-propelled street sweeper including a main frame, sweepings pick-up means underlying the main frame and a dirt box positioned on the frame for receiving the sweepings, the improvement comprising:

a main broom mounted at a rear end of said main frame adapted to sweep sweepings to the sweepings pick-up means so the sweepings can be deposited into the dirt box and having sweeping and road travel positions;

means for driving said main broom when in its sweeping position;

means for suspending the main broom from the rear end of said main frame including suspension arms located on opposite sides of said main broom;

bearing means between said suspension arms and said opposite sides of said main broom;

floating suspension means operatively connected between said main broom and said main frame providing a floating suspension for enabling said main broom to freely float on a ground supporting surface as the main broom is dragged behind said main frame in road engagement, the sweeper including the main frame and the main broom having a longer overall length when said main broom is in its sweeping position as compared to its road travel position;

and broom lift mechanism connected with said suspension arms which is operatively inactive when said main broom is in floating suspension in its sweeping position, said broom lift mechanism being so operable with said main broom to move said main broom forwardly through an arc out of road engagement over the main frame to its road travel position thus then shortening the overall length of the sweeper for road travel, the broom lift mechanism including a first hydraulically actuated means for initiating the broom pick-up from the road surface by rotating said main broom and said suspension arms on said bearing means, means cooperable with said first hydraulically actuated means for assisting in elevating said main broom through a second stage of clockwise movement of said main broom and said broom lift mechanism including a third stage broom lift means including lifting links for further clockwise movement of said main broom causing said suspension arms to be moved into an upright position relative to said main frame.

12. The sweeper of claim 11 further characterized by self-operating cam acting lock means being provided for positively locking said suspension arms in the upright position relative to the main frame to secure the main broom in the road travel position on said main frame.

13. The sweeper of claim 12 further characterized by said lock means being releasable upon reactivation of said first hydraulically activated means which is operable in an opposite direction when rotating the main broom and the suspension arms on said bearing means in a counter-clockwise direction for releasing said lock means and ultimately for moving the main broom from the road travel position to its sweeping position.

* * * * *